US007610718B2

(12) United States Patent
Kopish

(10) Patent No.: US 7,610,718 B2
(45) Date of Patent: Nov. 3, 2009

(54) SLIDING DOOR WITH LATERAL SEALING MOVEMENT

(75) Inventor: Andrew J. Kopish, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 11/940,721

(22) Filed: Nov. 15, 2007

(65) Prior Publication Data

US 2009/0126279 A1 May 21, 2009

(51) Int. Cl.
*E05F 11/52* (2006.01)

(52) U.S. Cl. ..... 49/211; 49/209; 49/216; 49/218

(58) Field of Classification Search ..... 49/209, 49/210, 211, 216, 218
See application file for complete search history.

(56) References Cited

U.S. PATENT DOCUMENTS

| | | | | |
|---|---|---|---|---|
| 1,357,244 | A | 11/1920 | Mitchell | |
| 1,719,203 | A | 7/1929 | Taussig | |
| 2,740,168 | A | 4/1956 | Wright | |
| 3,611,637 | A | 10/1971 | Saino | |
| 4,476,652 | A | 10/1984 | Beauchot | |
| 4,619,075 | A * | 10/1986 | Wiles | 49/235 |
| 5,461,829 | A * | 10/1995 | Lehto et al. | 49/409 |
| 5,468,032 | A | 11/1995 | Hebert et al. | |
| 5,505,023 | A * | 4/1996 | Gillen et al. | 49/380 |
| 5,799,444 | A * | 9/1998 | Freimark et al. | 49/413 |
| 6,826,867 | B1 * | 12/2004 | McDonald et al. | 49/213 |
| 7,155,861 | B2 | 1/2007 | Berry et al. | |

* cited by examiner

*Primary Examiner*—Jerry Redman
(74) *Attorney, Agent, or Firm*—Andrus, Sceales, Starke & Sawall, LLP

(57) ABSTRACT

A sliding door is secured to one side of a wall or partition panel having a door opening, and includes a trolley that is held in a track located above the door opening. The wheels or rollers of the trolley move along the track when the door is moved to a closed position until the roller contacts a wedge or ramp associated with the track. The wedge urges the roller inwardly toward the wall or partition panel, such that when the door is in the fully closed position, the trolley is positioned inwardly on the track to move the upper area of the door into engagement with the wall or partition panel. The lower end of the door includes a channel within which is positioned a follower attached to a swing arm, which simultaneously draws the lower end of the door into engagement with the wall or panel.

16 Claims, 6 Drawing Sheets

SLIDING DOOR WITH LATERAL SEALING MOVEMENT

BACKGROUND OF THE INVENTION

This invention pertains to sliding doors and, more particularly, to a sliding door assembly having structure that directs a sliding door to seal against a door frame, wall, or partition panel.

Office space build-outs often use demountable partition walls to establish individual workstations or offices. Not only do such demountable walls help maximize space, but they also allow for increased configurability or variability in the build-out. To further maximize the usable space within a given area, sliding doors, such as pocket doors or bypass doors, are increasingly used rather than conventional hinged swing doors.

Bypass doors, for example, are generally caused to slide along a door track that is laterally offset from the wall or partition panel in which the door opening is formed. Typically, a small gap is formed between the trailing edge of the door and the wall or partition panel when the door is slid to a fully closed position. This gap provides a conduit through which noise and light may pass, which affects the privacy of the area enclosed by the door.

One proposed solution has been the inclusion of a rubber or plastic trim piece either attached to the trailing edge of the sliding door or the jamb of the door opening. While reasonably effective at noise and light abatement, such trim pieces or seals may present obstructions to movement of the sliding door between open and closed positions if the trim pieces are not precisely connected to either the sliding door or the door jam. Also, increasingly, some users have found the use of such trim pieces to be unsightly.

BRIEF DESCRIPTION OF THE INVENTION

This invention is directed to a sliding door panel secured to one side of a wall or partition panel. The door includes one or more trolleys that move in a track located above the door opening. The wheels or rollers on each trolley move along the track when the door is moved to a closed position until the rollers contact a wedge or ramp located on or otherwise disposed in the track. The wedge urges the rollers inwardly toward the wall or partition panel, such that when the door is in the fully closed position, the trolley is positioned inwardly on the track to move the door laterally into engagement with the wall or partition panel. Also, the lower end of the door includes a channel within which is positioned a follower attached to a swing arm, which simultaneously draws the lower end of the door laterally into engagement with the wall or panel.

Therefore, in accordance with one aspect of the present invention, a door assembly includes a door track transverse to a vertical surface, which provides a path of travel for a door. The door track has a first track portion and a second track portion laterally offset from the first track portion along the path of travel. The door assembly further includes a doorstop disposed in the door track and configured to direct the door laterally from the first track portion to the second track portion into engagement with the vertical surface when the door is moved toward a closed position.

In accordance with another aspect, the present invention includes a sliding door system having a door sized to close an opening formed in a structure and having a trolley device connected thereto. The door system further includes a door retention track connected to the structure and configured to hold the trolley device and provide a surface along which the trolley device may travel so as to move the door between open and closed positions. The door system also includes a ramp positioned in the door retention track and configured to force the door laterally against the structure when the door is moved to a closed position.

According to a further aspect of the invention, a wall and door system is disclosed and includes a partition having a pair of vertical members and a transverse member collectively defining an opening. The system further includes a door track mounted to an opening side of the transverse member as well as a door retained in the door track. The door has at least one trolley device mounted to a top surface thereof that is held by the door track. The system further includes means for sealing the door against the pair of vertical members when the door closes the opening. The sealing means functions to engage the door with the partition so that the door contacts the partition to seal between the door and the partition when the door is positioned over the opening.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION

Figure 1:
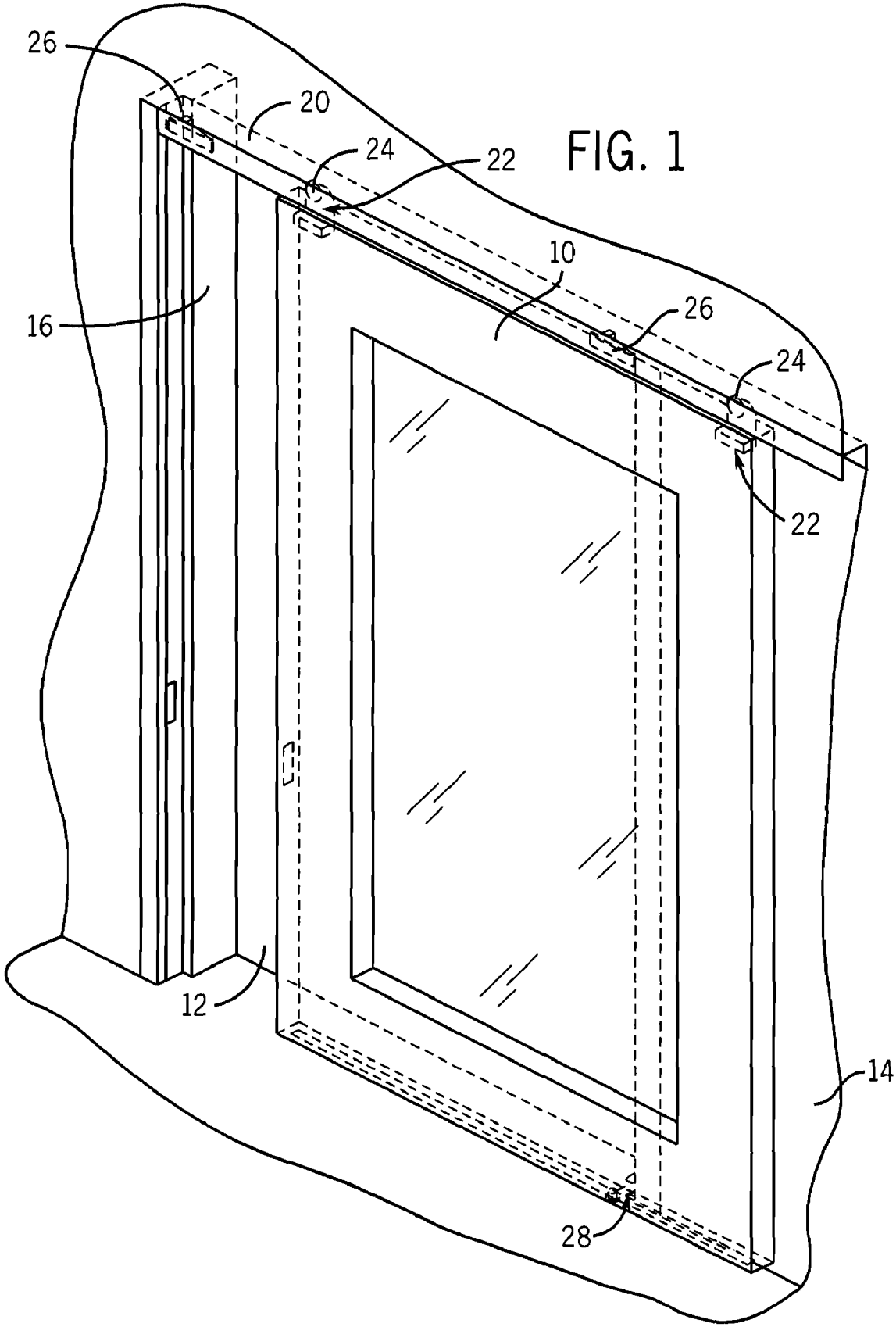
FIG. 1 is an isometric rear view of a door assembly in accordance with the present invention, including a sliding door positioned partially within an opening formed within a partition panel.
Figure 2:
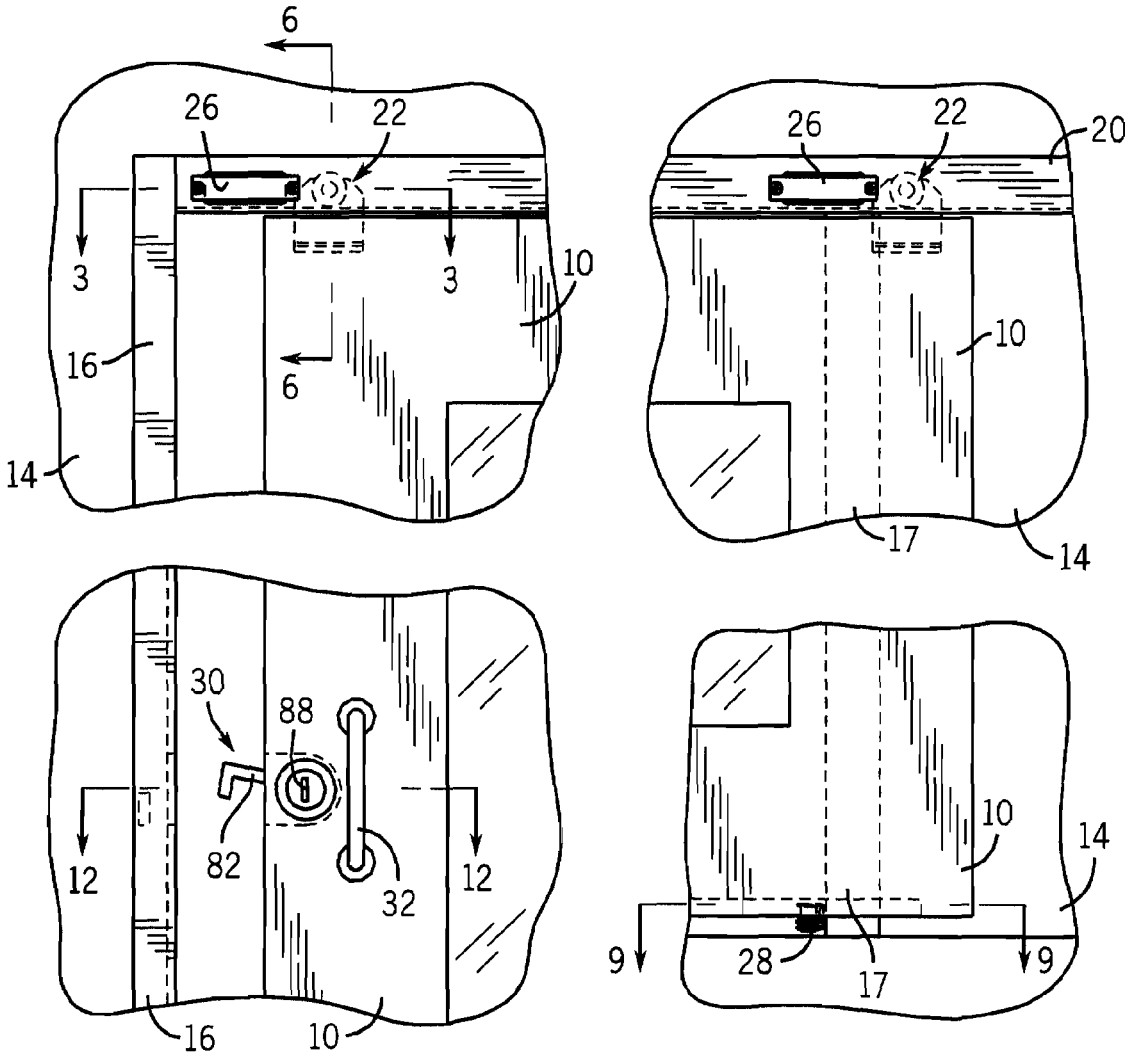
FIG. 2 is a front elevation view of various portions of the sliding door and partition panel shown in FIG. 1.

Referring now to FIGS. 1 and 2, a bypass-type sliding door 10 is shown partially closing an opening 12 formed in a wall or partition panel 14 that is partially defined by a pair of vertical members, such as posts 16, 17. Sliding door 10 is movable along a track 18, FIGS. 3-7, formed in a transverse member 20, which may be in the form of a header that extends along the length of the opening 12 and is connected to vertical posts 16, 17. Sliding door 10 includes a pair of trolley devices 22, each having a roller assembly 24 for carrying the trolley device along track 18. As will be described in greater detail below, track 18 includes a pair of blocks 26 that interrupt a portion of the track 18 so as to direct the trolley devices 22 inwardly. As will also be explained, a follower assembly 28 is also used to draw the sliding door 10 inwardly as the door 10 closes opening 12. Blocks 26, trolley devices 22, and follower assembly 28 cooperate to seal the sliding door 10 against the partition panel 14 or vertical posts 16, 17 when the sliding door 10 closes opening 12. As shown in FIG. 2, a lock assembly 30 may be used to lock door 10 to vertical post 16 when the door 10 is in the closed position. In the illustrated embodiment, the door 10 also includes a pull handle 32 that when gripped by a user, may be used to move the door 10 along track 18.

As described above, the present disclosure provides three separate devices to seal the sliding door 10 against vertical posts 16, 17 when the door 10 is in the closed position. In addition to providing improved noise abatement, these devices also improve the aesthetic appearance of the door and partition panel when the door is in the closed position by virtue of these devices moving the door laterally into engagement with the partition panel. Each of these devices will be separately discussed below.

Figure 3:
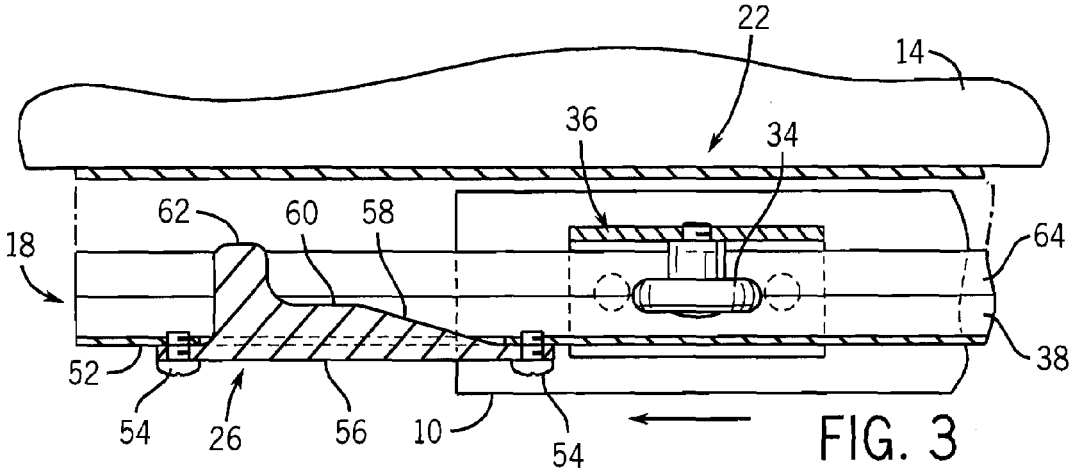
FIG. 3 is a cross-section view taken along lines 3-3 of FIG. 2.
Figure 6:
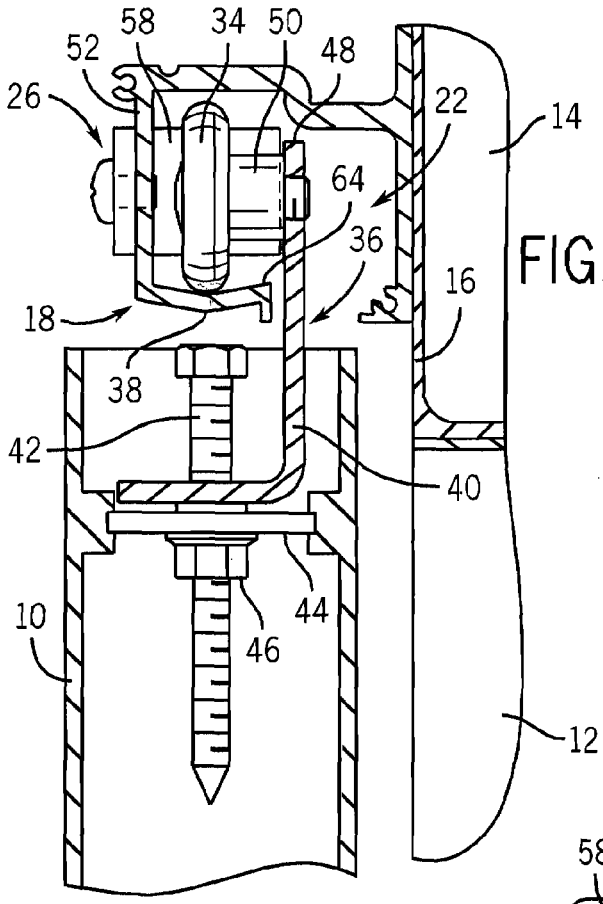
FIG. 6 is a cross-section view taken along lines 6-6 of FIG. 2.

Referring now to FIGS. 3 and 6, a representative trolley device 22 is shown positioned in track 18 at a location linearly spaced from block 26. In this position, the trolley device 22, which includes a roller or wheel 34 carried by a carriage 36, is shown being translated along a first portion 38 of track 18. As particularly shown in FIG. 6, carriage 36 has a J-shaped arm 40 that receives a jacking bolt 42 that may be secured to a mounting plate 44 of door 10 by a bolt 46. Arm 40 also includes a bore (not numbered) that retains retention pin 48, which supports a spacer 50 and roller 34. This arrangement effectively couples the door 10 to the trolley device 22 so that door 10 translates with the trolley device 22 as the trolley device 22 is moved along track 18. Track 18 is coupled to, or integrally formed with, a mounting bracket 52 that is secured against partition panel 14. Thus, the elevation or height of the track 18 is fixed relative to the partition panel 14, but the jacking bolt 42 and bolt 46 cooperate to allow adjustment in the height of the door 10 relative to track 18.

Referring again to FIG. 3, block 26 is secured to mounting bracket 52 by a pair of mounting screws 54, and has a wedge-shaped body 56 that includes an angled leading edge 58, a planar wall 60, and a stop 62. As shown in FIG. 3, leading edge 58 extends into and gradually interrupts the first portion 38 of track 18. Wall 60 is generally aligned with track 18 and extends throughout the majority of its length into the first portion 38 of track 18. In contrast, stop 62 interrupts both the first portion 38 as well as a second portion 64 of track 18.

Figure 4:
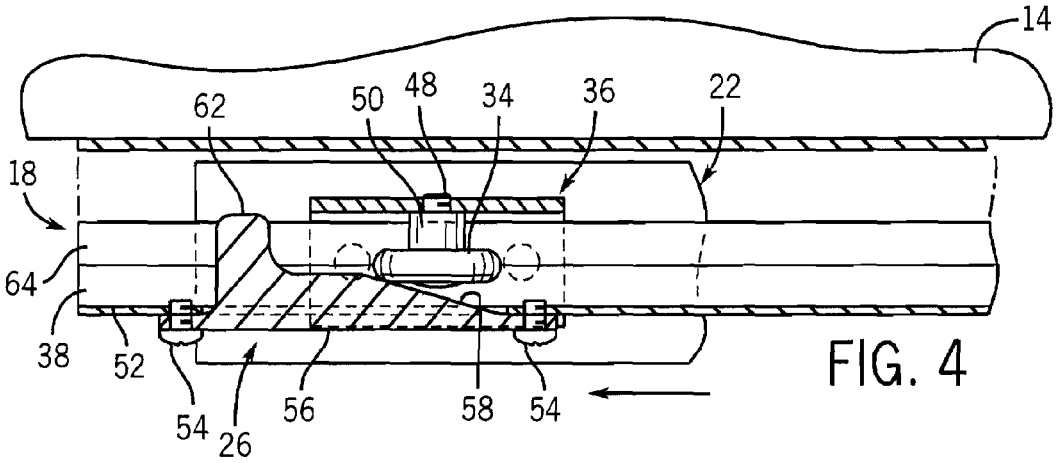
FIG. 4 is a cross-section view similar to the view of FIG. 3 showing the sliding door moved toward a closed position.
Figure 5:
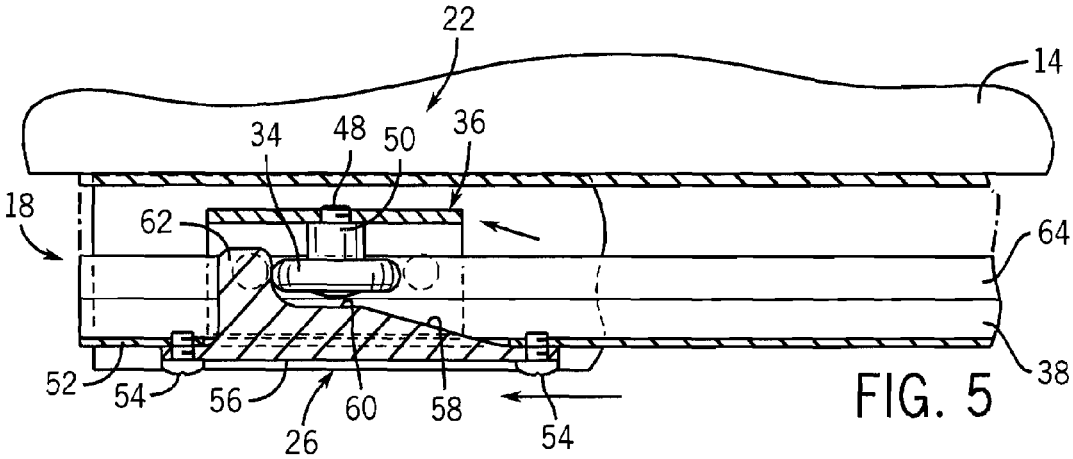
FIG. 5 is a cross-section view similar to the view of FIGS. 3 and 4 showing the sliding door moved to a closed position.

Thus, as shown in FIG. 4, when the trolley device 22, and therefore door 10, is translated toward the closed position, roller 34 engages the leading edge 58 of body 56. The leading edge 58, which is angled from the first track portion 38 toward the second track portion 64, urges the trolley device 22, and thus the door 10 inwardly from the first track portion 38 to the second track portion 64. As the door 10 is urged to the closed position, shown in FIG. 5, the roller 34 rides along the second track portion 64 until the roller abuts against stop 62. When the door 10 is in the closed position (FIG. 5), the trolley device 22, and thus the door 10, is laterally offset from the position when the door 10 is at the open position (FIG. 3). In this manner, door 10 is moved laterally into engagement with the surfaces of wall or partition panel 14 adjacent opening 12 when door 10 is moved to the closed position.

Figure 7:
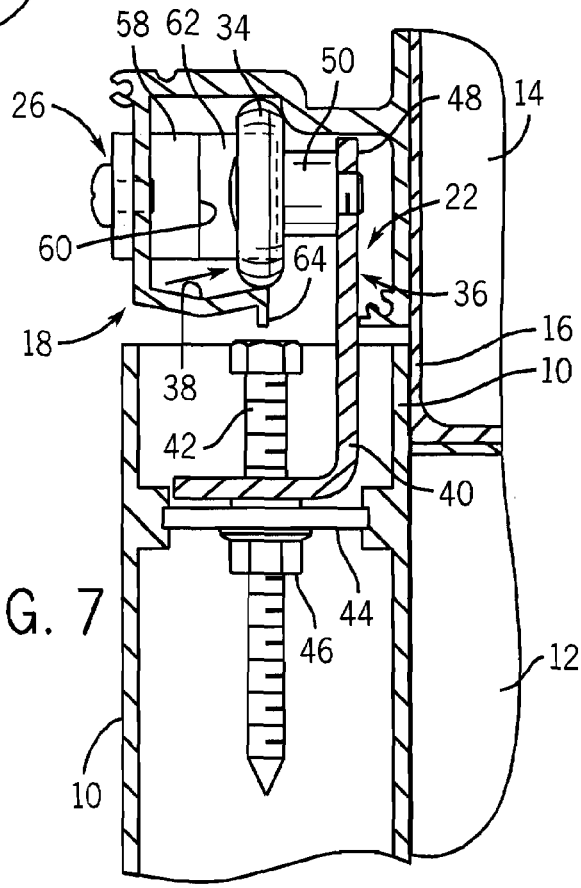
FIG. 7 is a cross-section view similar to the view of FIG. 6 showing the sliding door moved to the closed position.

As shown in FIG. 7, as the trolley device 22 is urged inwardly from first track portion 38 to second track portion 64 by leading edge 58 of block 26, the differences in height between the second track portion 64 and the first track portion 38 urges the trolley device 22, and thus the door 10, slightly upward. In this regard, while the door 10 is urged slightly upward, the track 18 causes this upward movement rather than the angled leading edge 58 of body 56. In other words, the roller 34 rides against leading edge 58 rather than on leading edge 58, which causes the trolley device 22 and thus door 10 to be moved inwardly.

Figure 8:
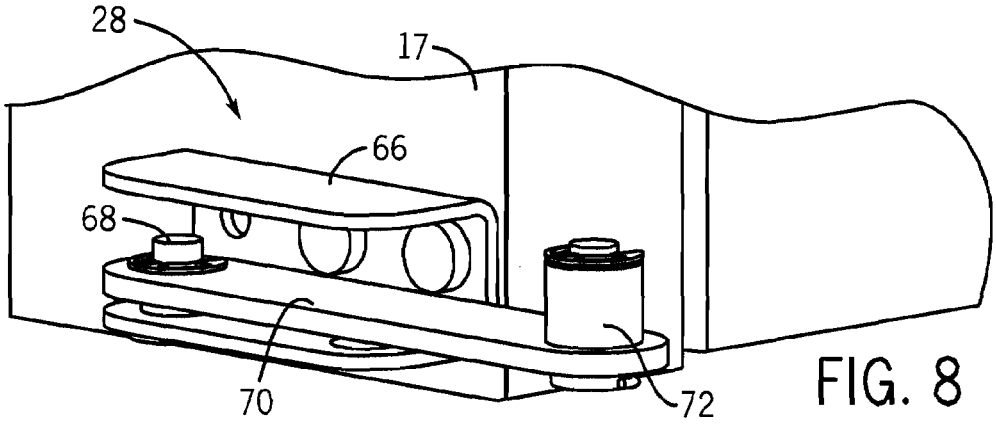
FIG. 8 is an isometric view of a follower device incorporated in the door assembly of the present invention.

While the block 26 urges the upper area of door 10 inwardly as door 10 is moved to the closed position, follower assembly 28 (FIG. 8) functions to move the lower area of door 10 inwardly. In this regard, blocks 26 and follower assembly 28 cooperate to seal the door 10 snugly against the surfaces adjacent opening 12, e.g. against vertical posts 16, 17.

Follower assembly 28 includes a swing guide 66 that is mounted to vertical post 17. A retaining pin 68 is engaged through an opening in swing guide 66 and functions to pivotably connect swing arm 70 to swing guide 66. Swing arm 70 carries a follower 72 that fits within a groove 74 formed in the downwardly facing surface of door 10, as shown in FIGS. 9-11.

Figure 9:
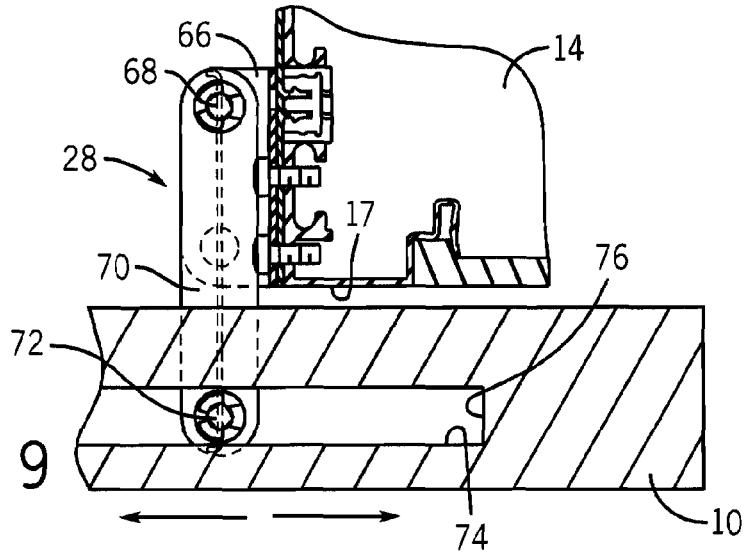
FIG. 9 is a cross-section view taken along lines 9-9 of FIG. 2.
Figure 10:
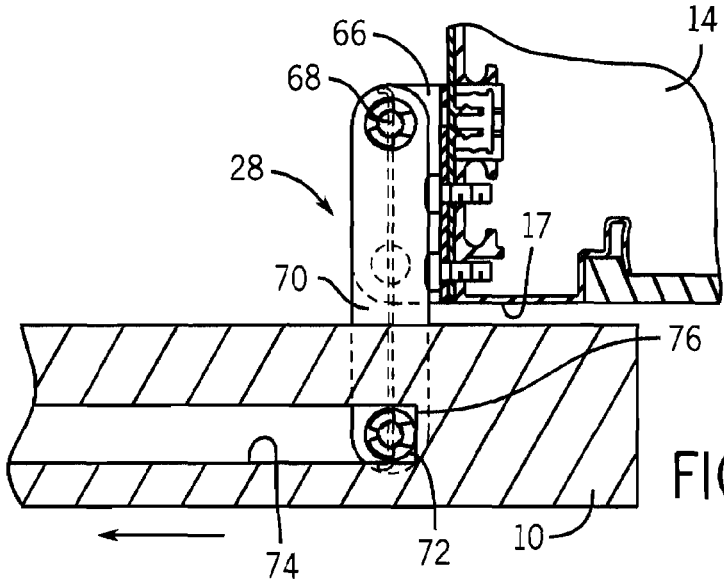
FIG. 10 is a cross-section view similar to the view of FIG. 9 showing the sliding door moved toward a closed position.
Figure 11:
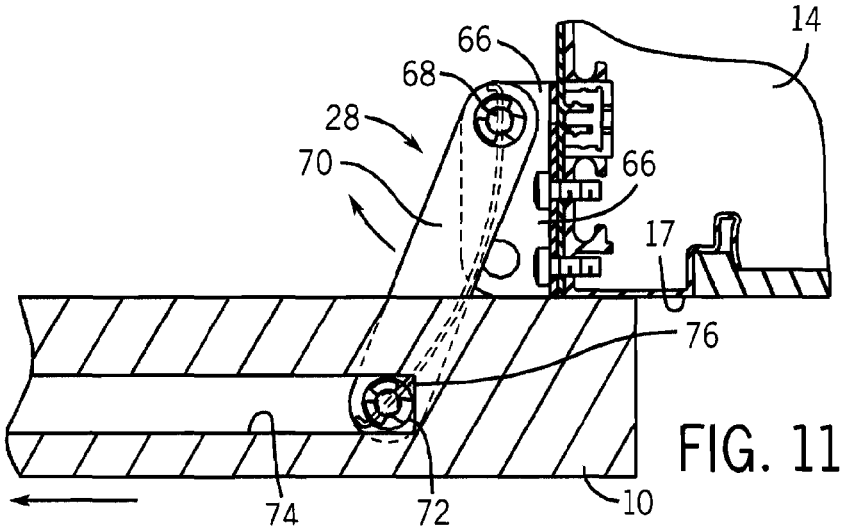
FIG. 11 is a cross-section view similar to the view of FIGS. 9 and 10 showing the sliding door moved to a closed position.

As the door 10 is moved along track 18 from an open position as shown in FIG. 9 toward a closed position as shown in FIGS. 10 and 11, the follower 72 rides within groove 74. As the door 10 approaches the closed position (FIG. 10), the follower 72 engages an end wall 76 of the groove 74. As the door 10 is further translated toward the closed position, engagement of the groove end wall 76 with the follower 72 functions to move the follower 72 along with the door 10, which causes the swing arm 70 to pivot about pin 68, as shown in FIG. 11. As the swing arm 70 pivots about pin 68, swing arm 70 acts to pull door 10 inwardly toward vertical post 17. When the door 10 has reached the closed position, the swing arm 70 is configured to pull the door 10 snugly against the surface of vertical post 17 adjacent opening 12. Accordingly, when the trolley device 22 has reached the position shown in FIGS. 5 and 7, the follower assembly 28 will be at the position shown in FIG. 11. In this regard, the trolley devices 22, blocks 26, and follower assembly 28 cooperate to urge both the upper and lower areas of the door 10 against the vertical posts 16, 17 and into engagement with the surfaces of partition panel 14 adjacent opening 12.

Figure 12:
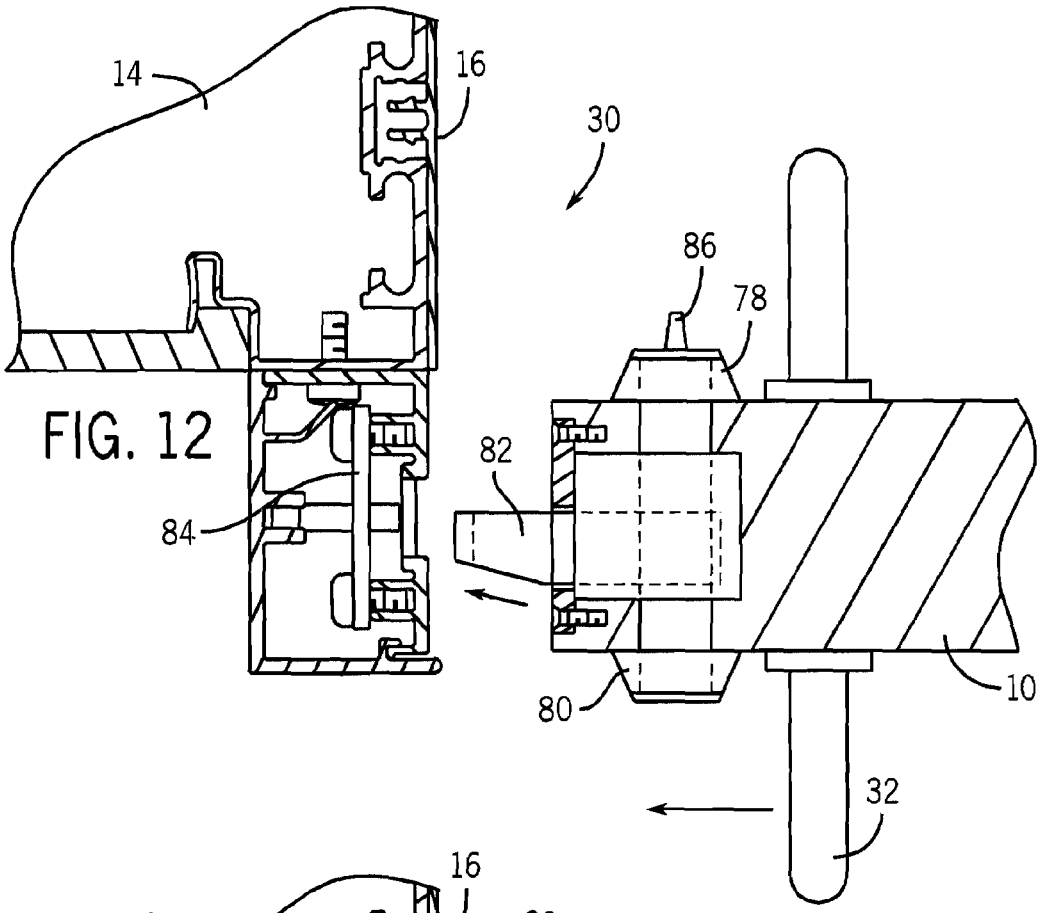
FIG. 12 is a cross-section view taken along lines 12-12 of FIG. 2.
Figure 13:
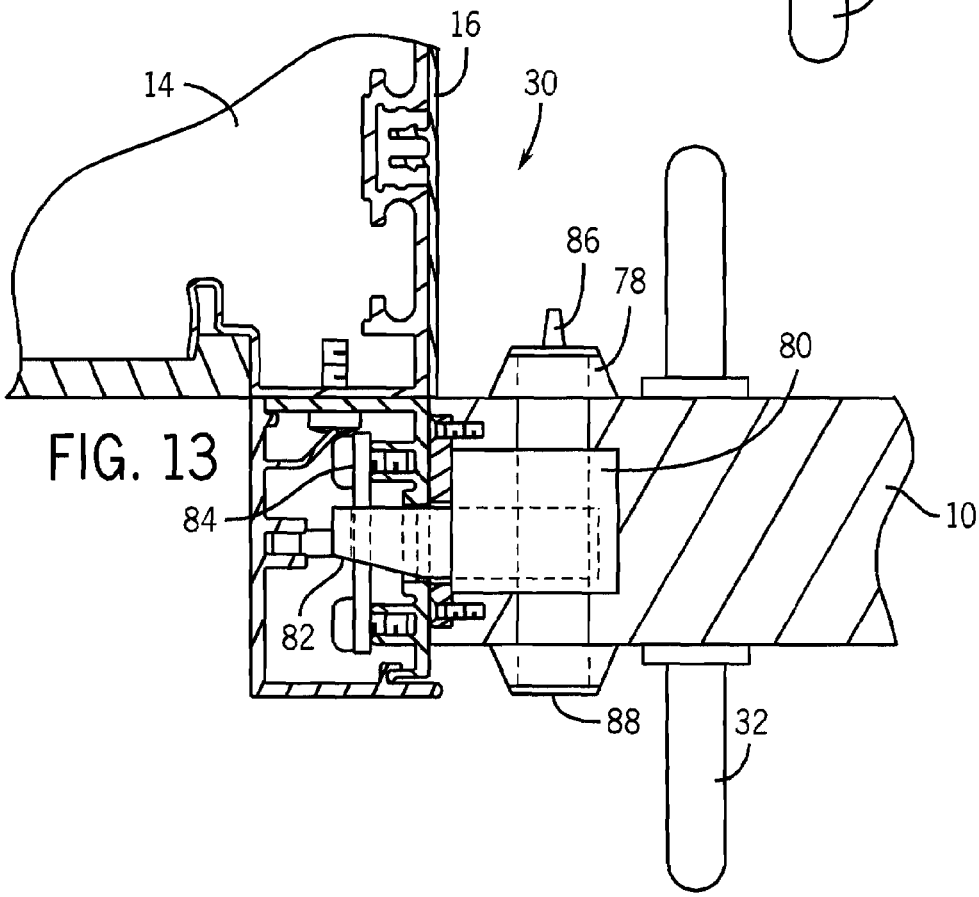
FIG. 13 is a cross-section view similar to the view of FIG. 12 showing the sliding door moved to a closed position.

If desired, lock assembly 30 may be used to lock the door 10 to vertical post 16. While a number of different lock assemblies may be used, one exemplary lock assembly 30 is shown in FIGS. 12 and 13. Lock assembly 30 includes a cylinder 78 carrying a shaft 80 and a strike 82. The strike 82 engages and is received by a strike plate 84. Once received in the strike plate 84, strike 82 may be locked by rotating handle 86. Optionally, the lock assembly 30 may include a keyhole 88 that permits insertion of a suitable key to lock or unlock the door 10 to or from vertical post 16.

The present invention has been described in terms of the preferred embodiment, and it is recognized that equivalents, alternatives, and modifications, aside from those expressly stated, are possible and within the scope of the following claims.

I claim:

1. A sliding door assembly for selectively closing an opening in a vertical surface, comprising:

a door having at least one roller provided with a rounded edge and a pair of sidewalls;

a door track that extends transverse to the vertical surface, wherein the door track defines a path of travel for the door for movement between an open position and a closed position, wherein the door track includes a first track portion and a second track portion laterally offset from the first track portion along the path of travel and wherein the rounded edge of the roller directly engages and rolls along either the first track portion or the second track portion; and a doorstop associated with and spaced from the door track and configured to direct the door laterally from the first track portion to the second track portion into engagement with the vertical surface when the door is moved from the open position toward the closed position, wherein the doorstop includes a planar ramp inclined in a direction from the first track portion toward the second track portion along the path of travel of the door between the open position and the closed position, and wherein the ramp is configured to engage against one of the sidewalls to direct the roller from the first track portion to the second track portion when the door is moved toward the closed position.

2. The sliding door assembly of claim 1 further comprising a trolley mountable to a door and configured to be retained by the door track, the trolley having the roller that rolls along the door track to translate the door along the path of travel.

3. The sliding door assembly of claim 2 wherein the trolley further comprises:

a roller support frame;

a boss extending laterally from the roller support frame; and a retention pin that holds the roller and couples the boss to the roller support frame.

4. The sliding door assembly of claim 1 wherein the second track portion is inward of the first track portion.

5. The sliding door assembly of claim 1 wherein the ramp interrupts the path of travel along the first track portion.

6. The sliding door assembly of claim 5 wherein the doorstop further comprises:

a first wall extending into the second track portion and terminating the path of travel along the second track portion; and a second wall transverse to the first wall and connected between the first wall and the ramp, wherein the second wall is oriented parallel to the path of travel.

7. The sliding door assembly of claim 1 wherein the door track is shaped such that the second track portion is inclined relative to the first track portion.

8. The sliding door assembly of claim 1 wherein the doorstop is positioned relative to the door track such that a gap is formed between a bottom surface of the doorstop and the first and the second track portions.

9. A sliding door system, comprising:

a door sized to close an opening formed in a structure and having a trolley device connected thereto, the trolley device having a roller provided with a rounded edge and a pair of sidewalls;

a door retention track connected to the structure, the door retention track configured to hold the trolley device and provide a surface directly engaged by the rounded edge of the roller of the trolley device so as to move the door between open and closed positions; and a laterally facing planar ramp positioned in the door retention track in spaced relationship to the surface engaged by the roller and configured to force the door laterally against the structure when the door is moved to the closed position, wherein the ramp is configured to engage against one of the sidewalls of the roller to direct the roller from one side of the track surface to an opposite side of the track surface when the door is moved to the closed position.

10. The sliding door system of claim 9 wherein the trolley device further comprises:

a roller support frame;

a boss extending laterally from the roller support frame; and a retention pin that holds the roller and couples the boss to the roller support frame.

11. The sliding door system of claim 9 further comprising a doorstop connected to the ramp and configured to stop translation of the trolley device when engaged therewith.

12. The sliding door system of claim 9 wherein the door retention track comprises a first track portion and a second track portion, and wherein the trolley device travels along the first track portion as the door is being moved from the open position toward the closed position, and wherein the ramp forces the trolley device to travel along the second track portion when the door is moved proximate the closed position.

13. The sliding door system of claim 12 wherein the second track portion is elevated relative to the first track portion.

14. A sliding door system, comprising:

a door sized to close an opening formed in a structure and having a trolley device connected thereof;

a door retention track connected to the structure, the door retention track configured to hold the trolley device and provide a surface along which the trolley device may travel so as to move the door between open and closed positions;

a laterally facing ramp positioned in the door retention track and configured to force an upper area of the door laterally against the structure when the door is moved to the closed position; and a follower that draws a lower area of the door against the structure as the upper area of the door is forced against the structure, wherein the follower comprises a swing guide mounted to the structure and a swing arm retained by the door at one end and coupled to the swing guide at an opposite end.

15. The sliding door system of claim 14 wherein the door includes a lock for locking the door when at the closed position.

16. A wall and door system comprising:

a wall having a pair of vertical surfaces and a transverse surface collectively defining an opening;

a door track associated with an opening side of the transverse surface;

a door slidably retained by the door track to move between open and closed positions relative to the opening, the door having at least one trolley device having a roller with a rounded edge which directly engages the door track and a pair of side walls which are spaced from the door track, and the trolley device mounted to an upper area thereof and held by the door track for movement thereon; and guide means mounted within the door track which guides the trolley device and moves the door laterally into engagement with the pair of vertical surfaces when the door closes the opening, wherein the guide means includes a planar ramp facing the wall and selectively engages against one of the sidewalls of the roller to direct the trolley device from a first portion of the door track to a second portion of the door track laterally offset from the first portion when the door is moved to the closed position.

* * * * *